US005588158A

United States Patent [19]

Poulson et al.

[11] Patent Number: 5,588,158

[45] Date of Patent: Dec. 31, 1996

[54] BATH RING

[75] Inventors: Keith L. Poulson, Westminster; Robert M. Parker, Aurora, both of Colo.; Jon R. Rossman, Chelmsford; Bryan R. Hotaling, Arlington, both of Mass.

[73] Assignee: Gerry Baby Products Company, Thornton, Colo.

[21] Appl. No.: 554,729

[22] Filed: Nov. 7, 1995

[51] Int. Cl.[6] ..... A47K 3/024

[52] U.S. Cl. ..... 4/572.1; 4/571.1

[58] Field of Search ..... 4/572.1, 571.1, 4/573.1, 578.1, 579, 586, 587, 590; 297/418, 467, 5

[56] References Cited

U.S. PATENT DOCUMENTS

| | | | |
|---|---|---|---|
| D. 169,271 | 4/1953 | McWaide | D15/1 |
| D. 188,838 | 9/1960 | Johnson, Jr. | D4/4 |
| D. 288,118 | 2/1987 | Boucher | D23/69 |
| D. 332,529 | 1/1993 | Shuler | D6/333 |
| D. 334,052 | 3/1993 | Haran | D23/304 |
| 1,406,779 | 2/1922 | Thibadore . | |
| 1,769,722 | 7/1930 | Sutton . | |
| 2,177,998 | 10/1939 | Schuette | 4/185 |
| 2,237,177 | 4/1941 | Fischer | 4/185 |
| 2,285,900 | 6/1942 | Chapman | 4/185 |
| 2,379,340 | 6/1945 | Corbett | 4/185 |
| 2,438,979 | 4/1948 | Short | 119/101 |
| 2,503,938 | 4/1950 | Davis, Jr. | 4/185 |
| 2,788,055 | 4/1957 | Tumas | 155/36.5 |
| 3,031,229 | 4/1962 | Symbaluk | 297/390 |
| 3,248,741 | 5/1966 | Stout et al. | 4/148 |
| 3,493,976 | 2/1970 | Baker | 4/173 |
| 3,528,111 | 9/1970 | Chou | 4/185 |
| 3,619,823 | 11/1971 | Sackett | 4/148 |
| 3,995,331 | 12/1976 | Fotre et al. | 4/185 B |
| 4,881,281 | 11/1989 | Lavoine et al. | 4/572 |
| 4,951,329 | 8/1990 | Shaw | 4/568 |
| 5,005,902 | 4/1991 | Farnsworth et al. | 297/250 |
| 5,010,606 | 4/1991 | Bernstein et al. | 4/572 |
| 5,033,131 | 7/1991 | Paden | 4/572 |
| 5,071,192 | 12/1991 | Adler | 297/464 |
| 5,158,460 | 10/1992 | Bernstein et al. | 4/572.1 |
| 5,181,284 | 1/1993 | Raphael et al. | 4/572.1 |
| 5,276,926 | 1/1994 | Lopez | 4/568 |
| 5,317,765 | 6/1994 | Knoedler et al. | 4/572.1 |
| 5,321,859 | 6/1994 | Buckshaw et al. | 4/571.1 |

*Primary Examiner*—David J. Walczak
*Attorney, Agent, or Firm*—Biebel & French

[57] ABSTRACT

A bath ring is provided including a base portion, a ring portion having a back portion for supporting the back of a person seated on the base portion, an attachment member connecting the ring portion to the base portion, and a restraining member extending upwardly from a front edge of the base portion. The restraining member has a first portion pivotable about the base portion, and a second portion having a pair of distal ends. A lock mechanism associated with the first and second portions of the restraining member is adapted to engage with and disengage from a pair of slots located in an inwardly facing surface of the ring portion. The lock mechanism includes a first element with a pair of oppositely extending arm members and a central member from which each arm member extends, wherein the central member is compressible so that the arm members may be brought closer together, and a second element extending along the first portion of the retaining member. The first and second elements of the lock mechanism are located in adjoining relation so that the central member of the first element is compressed as the second element is moved upwardly.

23 Claims, 7 Drawing Sheets

BATH RING

BACKGROUND OF THE INVENTION

1. Field of the Invention

The present invention relates to a bath ring for supporting an infant and, more particularly, to a bath ring for supporting an infant having an improved locking mechanism for a pivotable front retainer member.

2. Description of Related An

Several devices have been proposed for supporting infants while taking a bath in a conventional bath tub. Such devices have typically included a ring or support rail for surrounding the infant and support posts for supporting the ring at a predetermined height. The post may be supported by a base forming a seat for the infant (e.g., U.S. Pat. No. 5,010,606 to Berstein, et al and Design U.S. Pat. No. 332,529 to Shuler) or may be attached directly to the bath tub bottom by means of suction cups (e.g., Design U.S. Pat. No. 288,118 to Boucher). Other known bath seat structures have consisted of a seat structure which incorporates straps for holding the infant in position, such as that disclosed in Design U.S. Pat. No. 169,271 to McWaide. U.S. Pat. No. 3,301,299 to Symbaluk further discloses a seat in the form of a shell for surrounding the infant which includes a crossbar extending between opposing sides of the seat and a central crotch belt extending from the crossbar to the bottom of the seat to retain the infant behind the crossbar.

The advantages of a removable or pivotable front retaining member for a bath ring are easily understood, as it facilitates placing an infant in the bath ring and removing the infant therefrom. This is particularly helpful since the physical movements for an infant to accomplish these purposes are somewhat awkward and may result in scrapes along the edge of the ring portion and frustration on the part of the person handling the infant. Accordingly, U.S. Pat. No. 5,317,765 to Knoedler et al discloses a collapsable infant bath ring which includes a T-bar front retainer which is pivotable about the base portion and may be brought into engagement with the ring portion at the distal ends of the horizontal section of the T-bar. As seen therein, the engaging end portions of the horizontal T-bar section are received by grooves within the ring portion. Further, a pair of locking tabs are provided on the ring portion which cooperate with respective locking recesses on the T-bar engaging end portions.

While the bath seats employing pivotable T-bars and the like are effective for their designed purpose, it has been found that the locking mechanism utilized therewith requires the use of two hands to engage and disengage it. Such a two-handed operation leaves the infant without assistance momentarily, thereby exposing him to a potential injury. Thus, it would be highly desirable for the lock mechanism of a from retainer to be simplified in order to permit one-handed operation. In this way, the other hand may be utilized to support the infant as the front retainer is pivoted out of engagement.

SUMMARY OF THE INVENTION

In accordance with one aspect of the present invention, a bath ring is provided including a base portion, a ring portion having a back portion for supporting the back of a person seated on the base portion, attachment means connecting the ring portion to the base portion, and restraining means extending upwardly from a front edge of the base portion.

The restraining means has a first portion pivotable about the base portion and a second portion having a pair of distal ends. A lock mechanism associated with the first and second portions of the restraining means is adapted to engage with and disengage from a pair of slots located in an inwardly facing surface of the ring portion.

In a second aspect of the present invention, a collapsible bath ring is provided including a base portion having a lower portion for engaging a surface to support the bath ring and an upper surface for supporting a person sitting in an upright position on the bath ring, the base portion defining a front edge and an opposing rear edge for the bath ring. The bath ring includes a ring portion having a curved back section, first and second arm sections extending forwardly from the back section, and first and second legs sections extending downwardly from the first and second arm sections, respectively. Attachment means couple the first and second leg sections of the ring portion to the base portion adjacent the front edge and form a pivotal connection between the ring portion and the base portion. A T-bar is provided having a vertical section with a first end attached to the base portion at a pivot connection between the first and second leg sections and a second end attached to a horizontal section of the T-bar. Locking means are located within the T-bar, where it is mounted for sliding movement toward and away from a locking surface in at least one of the first and second arm sections, the locking means cooperating with the locking surface in interlocking engagement to prevent relative movement between the T-bar and the ring portion.

Accordingly, it is an object of the present invention to provide a bath ring for supporting a person, such as an infant, in an upright sitting position.

It is a further object of the present invention to provide a bath ring with a front restraining member which may be pivoted away or removed from the ring portion of the bath ring.

Still another object of the present invention is to provide a bath ring with a front restraining member having a locking assembly which simplifies the engagement/disengagement process.

Yet another object of the present invention is to provide a bath ring with a front restraining member having a locking assembly which may be engaged and disengaged with only one hand.

Another object of the present invention is to provide a bath ring which includes means for counteracting tipping forces.

Still another object of the present invention is to provide a bath ring which may be collapsed to a compact form.

Other objects and advantages of the invention will be apparent from the following description, the accompanying drawings, and the appended claims.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Figure 1:
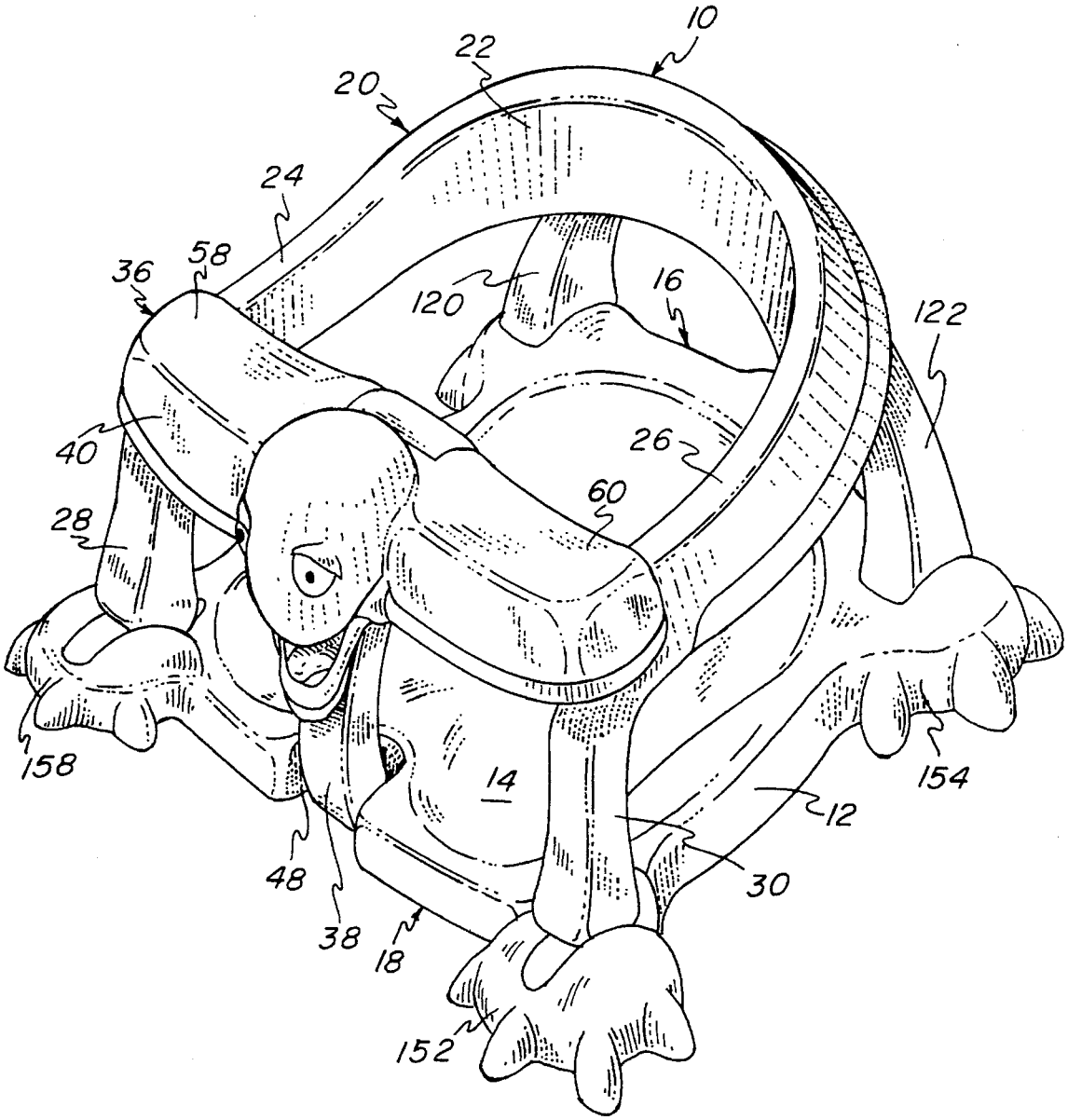
FIG. 1 is a perspective view of the bath ring of the present invention.

Referring to FIGS. 1–6, the present invention provides a bath ring 10 for supporting a person in an upright sitting position. Bath ring 10 includes a base portion 12 having an upper support surface 14, a curved back section 16, and a squared off front section 18.

A ring portion 20 is provided including a curved back section 22, first and second arm sections 24 and 26 extending forwardly from back section 22, and first and second leg sections 28 and 30 extending downwardly from first and second arm sections 24 and 26, respectively. Leg sections 28 and 30 are attached to base portion 12, preferably by means of a pair of pivot pins 32 and 34 (see FIG. 6) provided in base portion 12 for engaging within apertures formed in leg sections 28 and 30, to permit pivotal movement between ring portion 20 and base portion 12.

A from retaining member 36, preferably in the form of a T-bar, is provided which includes a vertical section 38 and a horizontal section 40. It will be seen in FIGS. 2 and 8 that front retaining member 36 is constructed of a front shell-like cover 42 and a rear planar cover 44, which are attached by a plurality of screws, rivets, or the like (see numeral 46) at a plurality of locations. Alternatively, an adhesive may be applied at the interfacing edges of front and rear covers 42 and 44.

It will be understood that front retaining member 36 is pivotally attached to a front edge of base portion 12 for movement toward and away from ring portion 20. Accordingly, base portion 12 is provided with a central front slot area 48 and a pair of pivot studs 50 and 52 which extend inwardly into front slot 48 for engaging front retaining member 36 (see FIGS. 3 and 6). Pivot studs 50 and 52 preferably define a common pivot axis with pivot pins 32 and 34 in order that ring portion 20 and front retaining member 36 may be pivoted together relative to base portion 12 while the relative position between ring portion 20 and front retaining member 36 remains unchanged.

Figure 2:
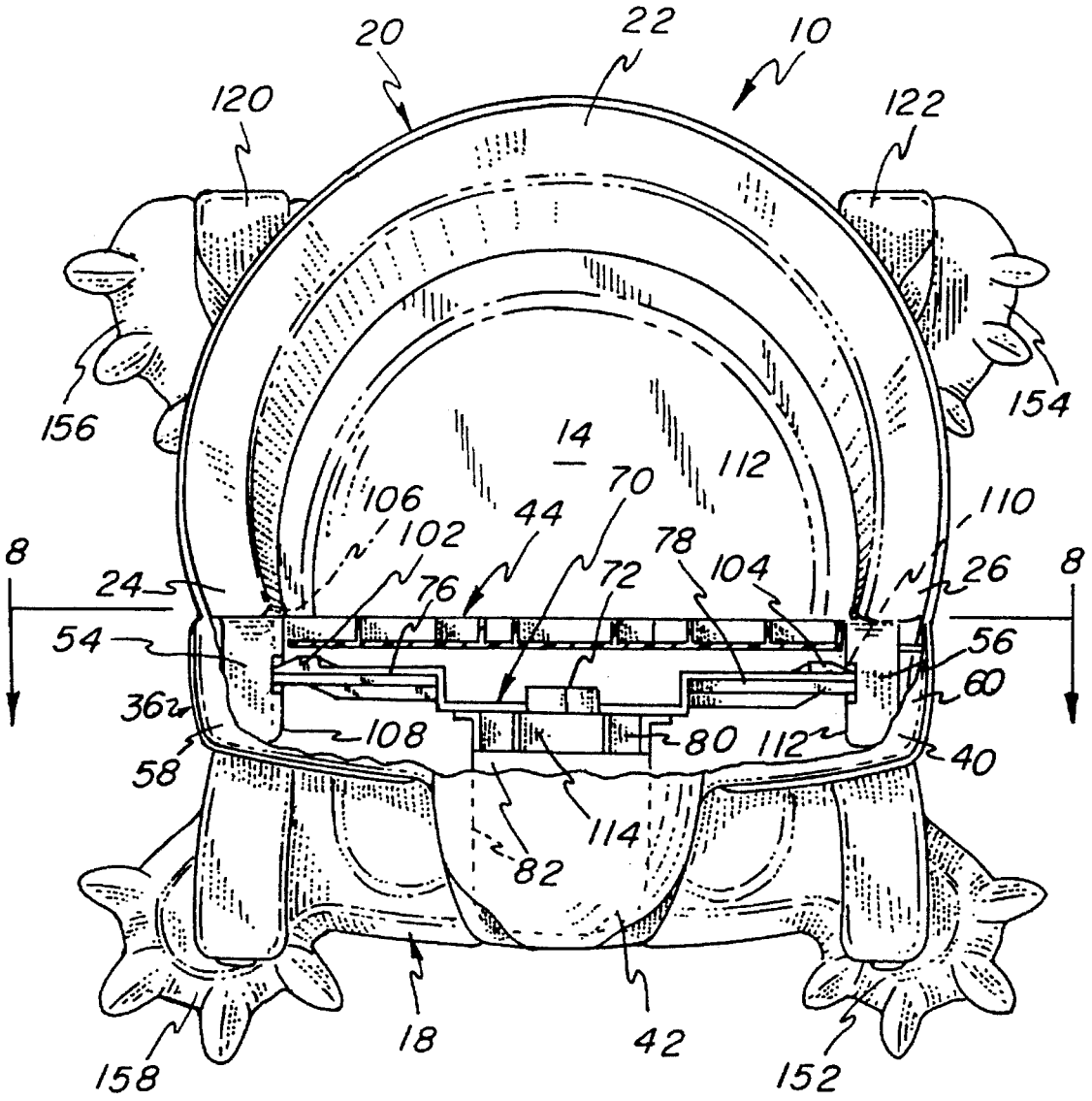
FIG. 2 is a top view of the bath ring depicted in FIG. 1, where a portion has been broken away to better show the locking mechanism associated with the front restraining member and the grooves in the ring portion's arm sections.
Figure 3:
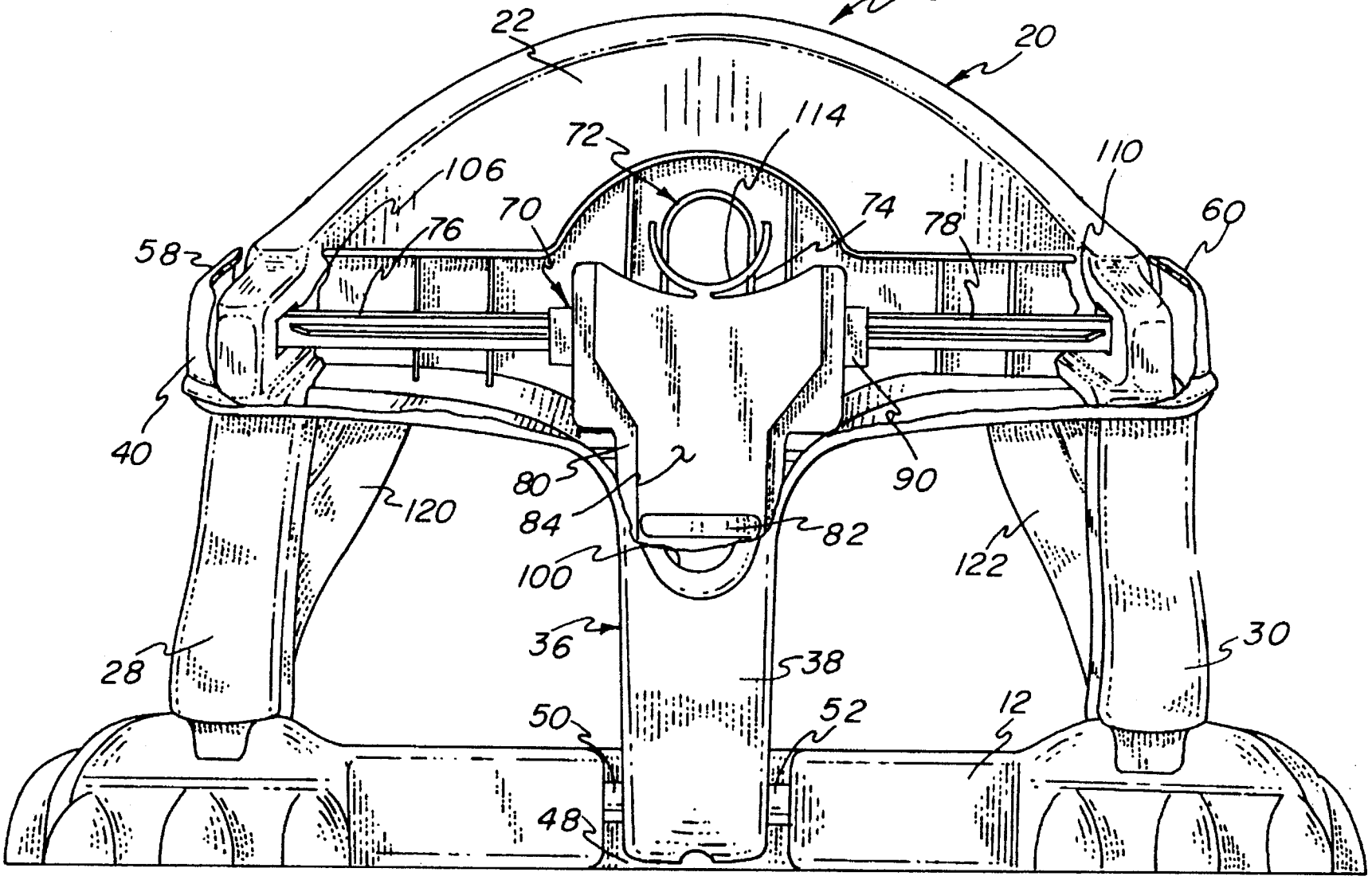
FIG. 3 is a front elevational view of the bath ring depicted in FIGS. 1 and 2, where a portion has been broken away to better show the locking mechanism associated with the front restraining member.
Figure 4:
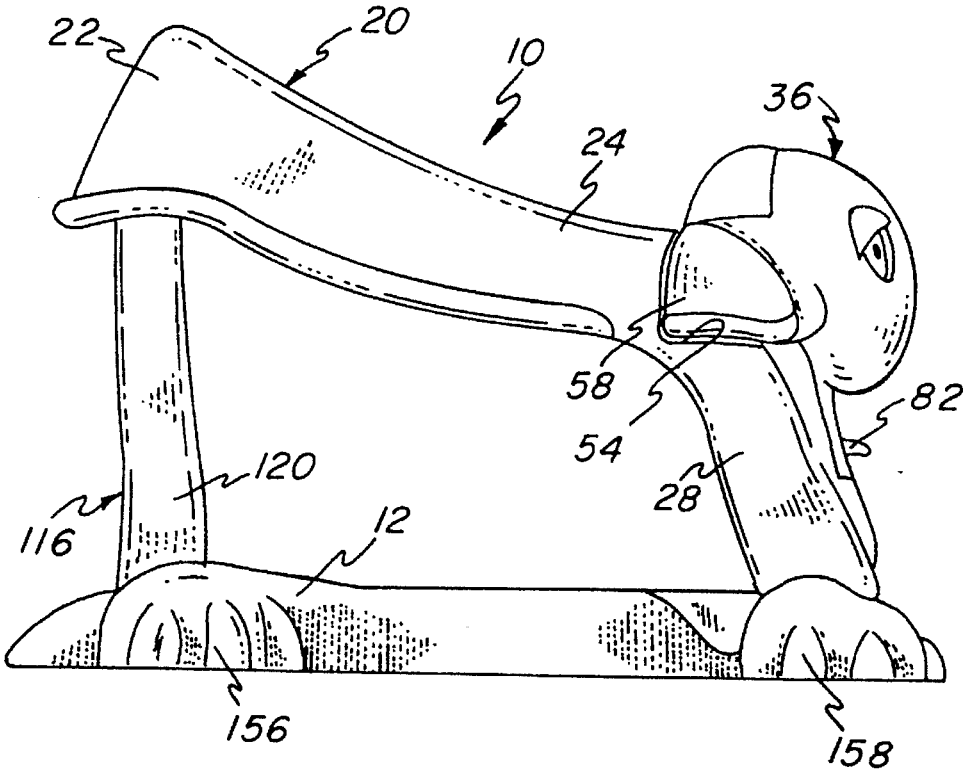
FIG. 4 is a side elevational view of the bath ring depicted in FIGS. 1–3.

Referring to FIGS. 2 and 4, arm sections 24 and 26 of ring portion 20 are provided with grooves 54 and 56, respectively, for receiving and engaging end portions 58 and 60 of front retaining member horizontal section 40. More specifically, it will be seen in FIG. 8 that rear cover 44 of front retaining member 36 includes a pair of substantially U-shaped cut out areas 62 and 64 which are located so as to allow end portions 58 and 60 to mate with grooves 54 and 56, respectively. It will be understood that in order for end portions 58 and 60 of front retaining member 36 to be disengaged from grooves 54 and 56 of first and second arm sections 24 and 26, respectively, front retaining member 36 must be first lifted slightly upwardly. Therefore, front retaining member 36 is provided with a pair of oval pivot sleeves for engaging pivot studs 50 and 52 so that front retaining member 36 may pivot about studs 50 and 52, as well as move in a longitudinal direction along the length of such oval sleeves.

Figure 7:
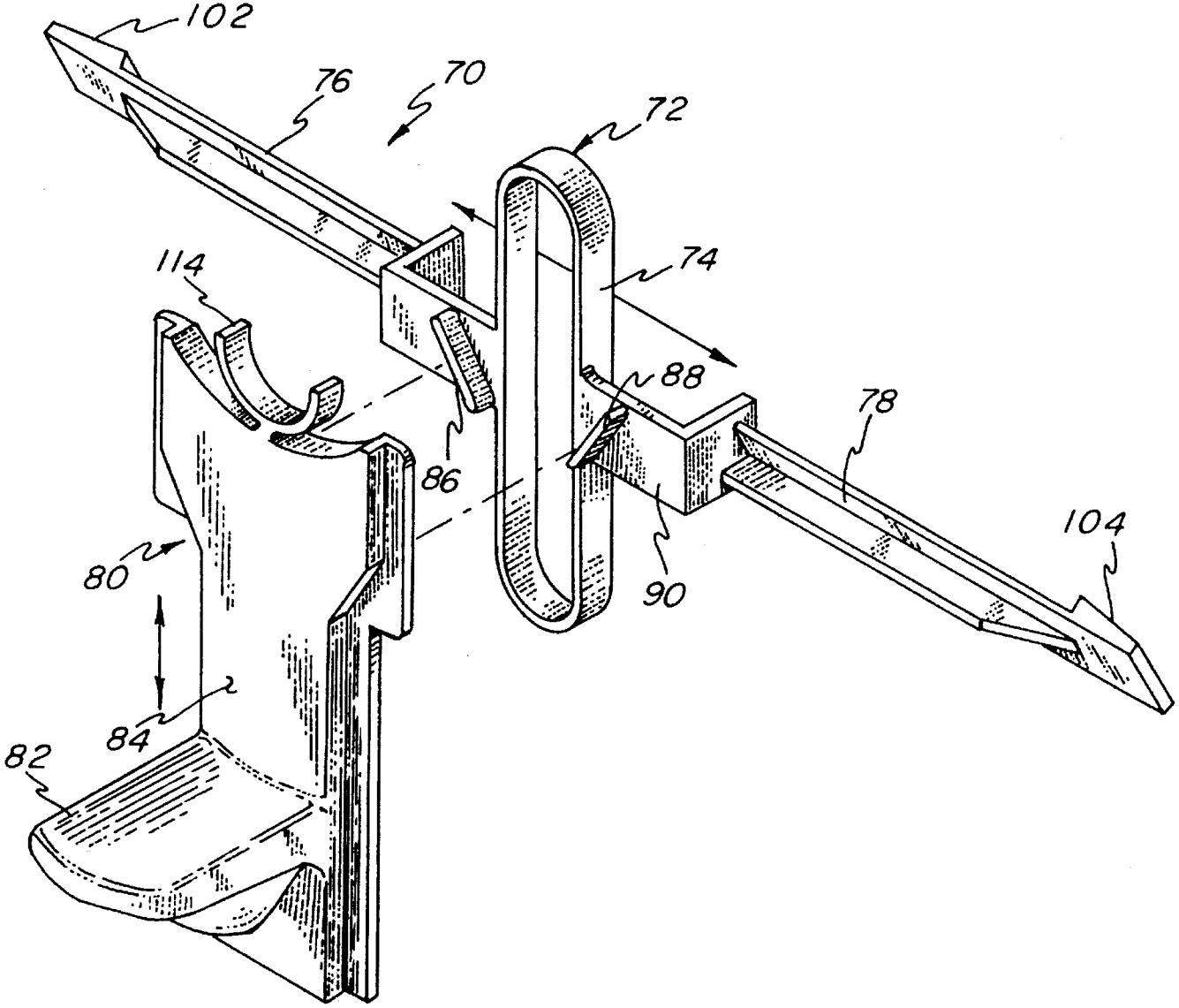
FIG. 7 is an exploded perspective view of the locking mechanism associated with the front retaining member.

In order to maintain end portions 58 and 60 of front retaining member 36 in position within grooves 54 and 56 of first and second arm sections 24 and 26, respectively, a lock mechanism generally indicated by the numeral 70 is provided. It will be seen from FIGS. 2 and 3 that lock mechanism 70 is generally located within from and rear covers 42 and 44 of front retaining member 36. More specifically, as best seen in FIG. 7, lock mechanism 70 includes a first element 72 which is positioned adjacent rear cover 44 of front retaining member 36. First element 72 further includes a central spring member 74 and a pair of arm members 76 and 78 extending oppositely therefrom. A second element 80 of lock mechanism 70 is positioned adjacent to front cover 42 of front retaining member 36 and notably includes a protruding member 82 from an outwardly facing surface 84 thereof.

It will be understood that first and second elements 72 and 80 of lock mechanism 70 work in tandem so that as second element 80 is moved upwardly, such as by exerting upward force on protruding member 82, central spring member 74 of first element 72 is compressed so that arm members 76 and 78 are moved toward each other in substantially uniform fashion. In particular, this is accomplished by means of a pair of tabs 86 and 88 located on an outwardly facing surface of an intermediate member 90 of first element 72 (located on each side of central spring member 74), which are located between a pair of rib-like walls 92 and 94 on an inwardly facing surface 96 of second element 80 (see FIG. 9). It will be noted that tabs 86 and 88 and ribs 92 and 94 are oriented at an angle to a vertical axis 98 of lock mechanism 70 so that ribs 92 and 94 enact a force on tabs 86 and 88, causing compression of central spring member 74 through intermediate member 90 when second element 80 is moved upwardly. A compression spring (not shown) may also be positioned within central spring member 74, such as on posts, if required for durability. Since it is preferred that protruding member 82 of second element 80 be utilized to cause such upward movement, an elongated opening 100 is provided in front cover 42 of front retaining member 36 to permit vertical movement therein.

Figure 8:
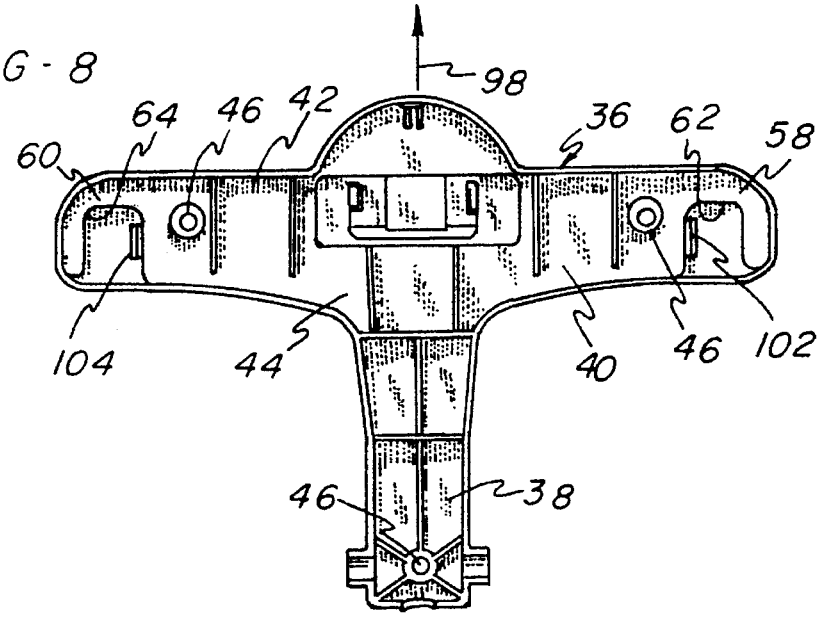
FIG. 8 is a rear view of the from retaining member taken along lines 8—8 of FIG. 2, the arm sections of the ring portion being omitted for clarity.
Figure 9:
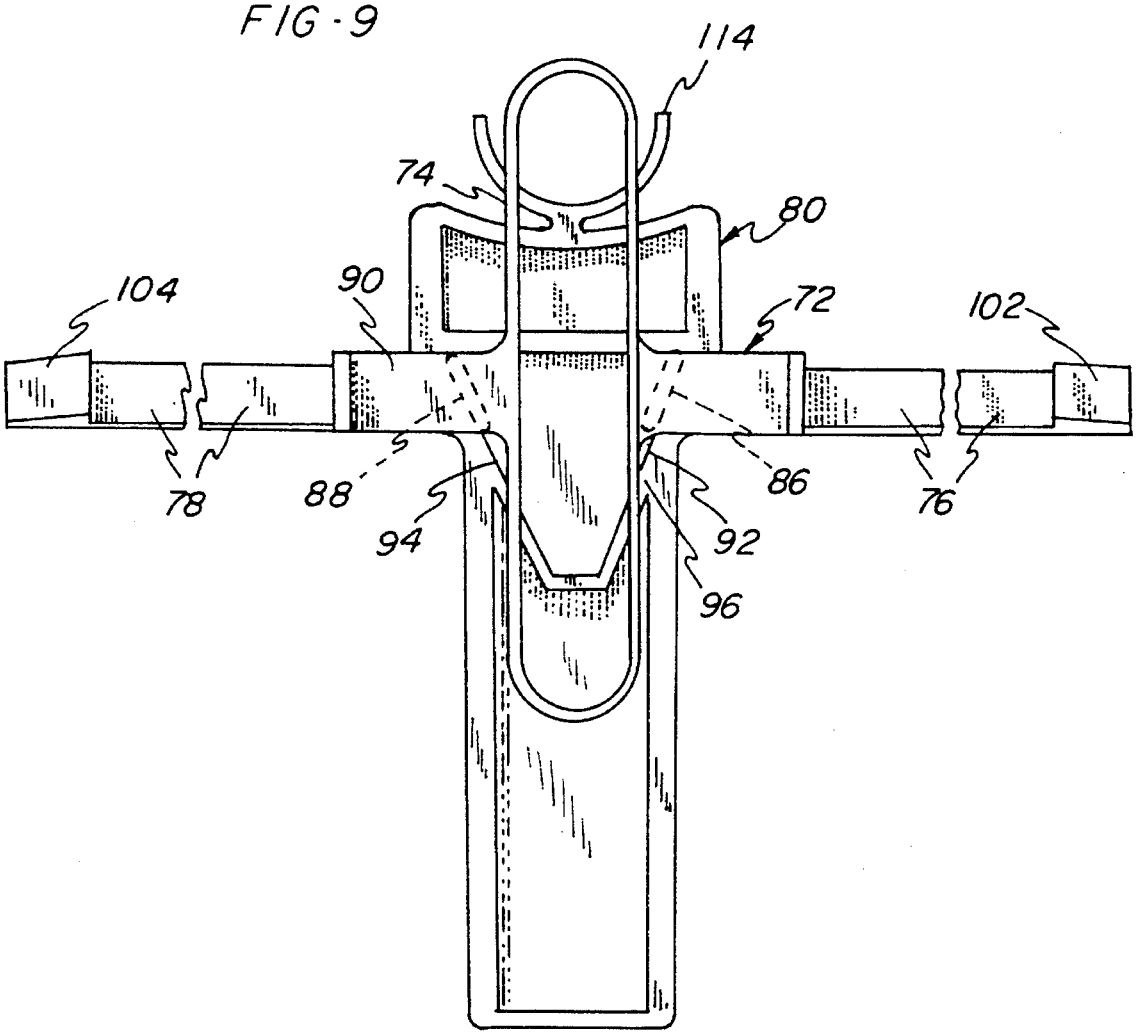
FIG. 9 is a rear view of the locking mechanism depicted in FIG. 7.

With respect to the locking engagement of front retaining member 36 to ring portion 20, it will be seen in FIGS. 7–9 that arm members 76 and 78 of first element 72 each include locking tips 102 and 104, respectively, which are able to be positioned in slots 106 and 110 positioned in inwardly facing surfaces 108 and 112 of first and second arm sections 24 and 26 of ring portion 20 (see FIG. 2). Further, tips 102 and 104 of arm members 76 and 78 will be biased outwardly into slots 106 and 110 unless central spring member 74 of first element 72 is compressed (as caused by moving second element 80 upwardly as described hereinabove). It should further be noted that second element 80 includes an upper spring member 114 which is positioned to be engaged by an upper portion of front cover 42 of front retaining member 36 when second element 80 is moved upwardly a prescribed amount. Nonetheless, it will be understood that second element 80 is biased downwardly principally by tabs 86 and 88 acting upon ribs 92 and 94 so that lock mechanism 70 will be in an engaged position at tips 102 and 104 unless and until upward movement of second element 80 occurs.

It will be noted that the structure of lock mechanism 70 enables a simplified engagement and disengagement process for front retaining member 36 and ring portion 20. Most importantly, such engagement and disengagement processes may be accomplished with a single hand (by performing the dual functions of controlling protruding member 82 and pivoting front retainer member 36), thereby enabling use of the other hand to support the infant within bath ring 10.

A rear support member 116 is preferably provided to assist in stabilizing the connection between ring portion 20 and base portion 12. It will be seen from FIG. 5 that rear support member 116 preferably includes an upper portion 118 which engages curved back section 22 of ring portion 20, as well as first and second lower portions 120 and 122 of rear support member 116 which engage a back section 16 of base portion 20 in order to support ring portion 20 in a predetermined spaced relationship from base portion 12. Although not required, it is preferred that rear support member 116 be pivotable from a support position in contact with ring portion 20 to a storage position beneath base portion 12. As seen in FIG. 6, base portion 12 includes a pair of pivot shafts 124 and 125 molded integrally with base portion 12 and located within a pair of rear slots 126 and 127, respectively, formed at the curved rear section 16 of base portion 20. It will be seen that first and second lower portions 120 and 122 include slots 128 and 129, respectively, therein which interconnect with pivot shafts 124 and 125 to form a pivot connection about which rear support member 116 pivots.

As further seen in FIG. 6, base portion 12 includes a bottom surface 130, which preferably has rib-like walls 132, 133 and 134 defining a slot 136 extending from the rear toward the front of base portion 12 for receiving rear support member 116 in a storage position. In addition, a pair of detents (not shown) preferably extend inwardly from walls 132 and 133 and a pair of corresponding detents (not shown) preferably extend outwardly from rear support member 116 for cooperating therewith when rear support member 116 is located within slot 136. Thus, as rear support member 116 is moved into position within slot 136, the rear support member detents move past the wall detents to thereby hold rear support member 116 in its storage position.

Figure 5:
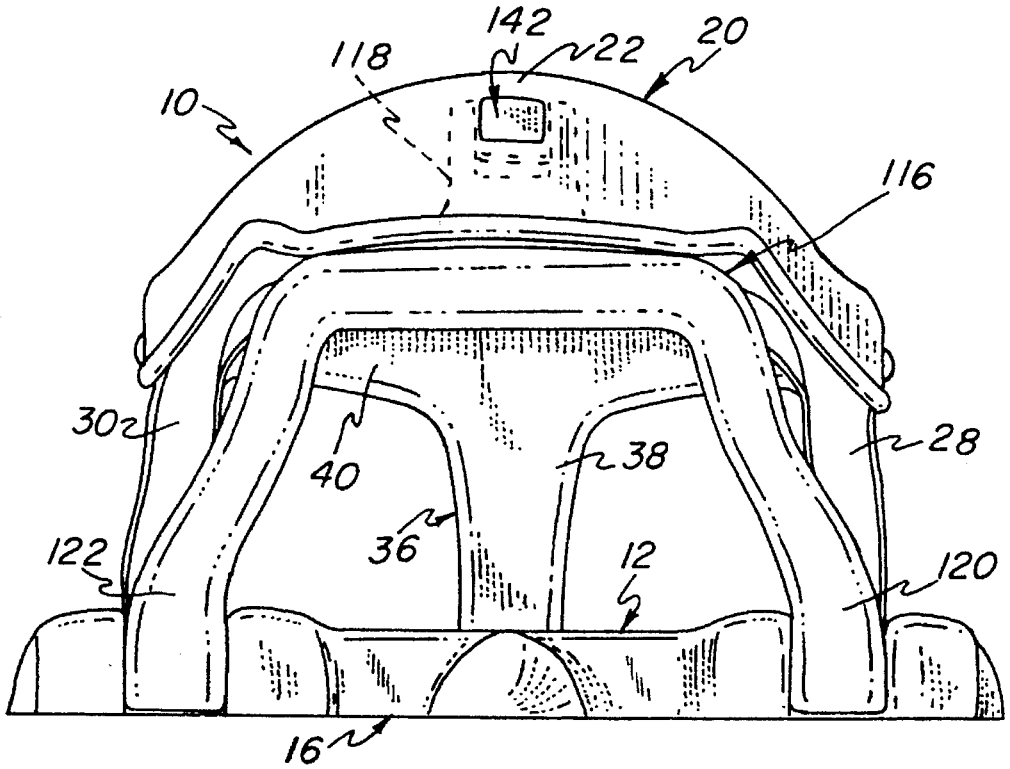
FIG. 5 is a rear elevational view of the bath ring depicted in FIGS. 1–4, where an upper portion of the rear support member and the lock mechanism therefor is shown in phantom.
Figure 6:
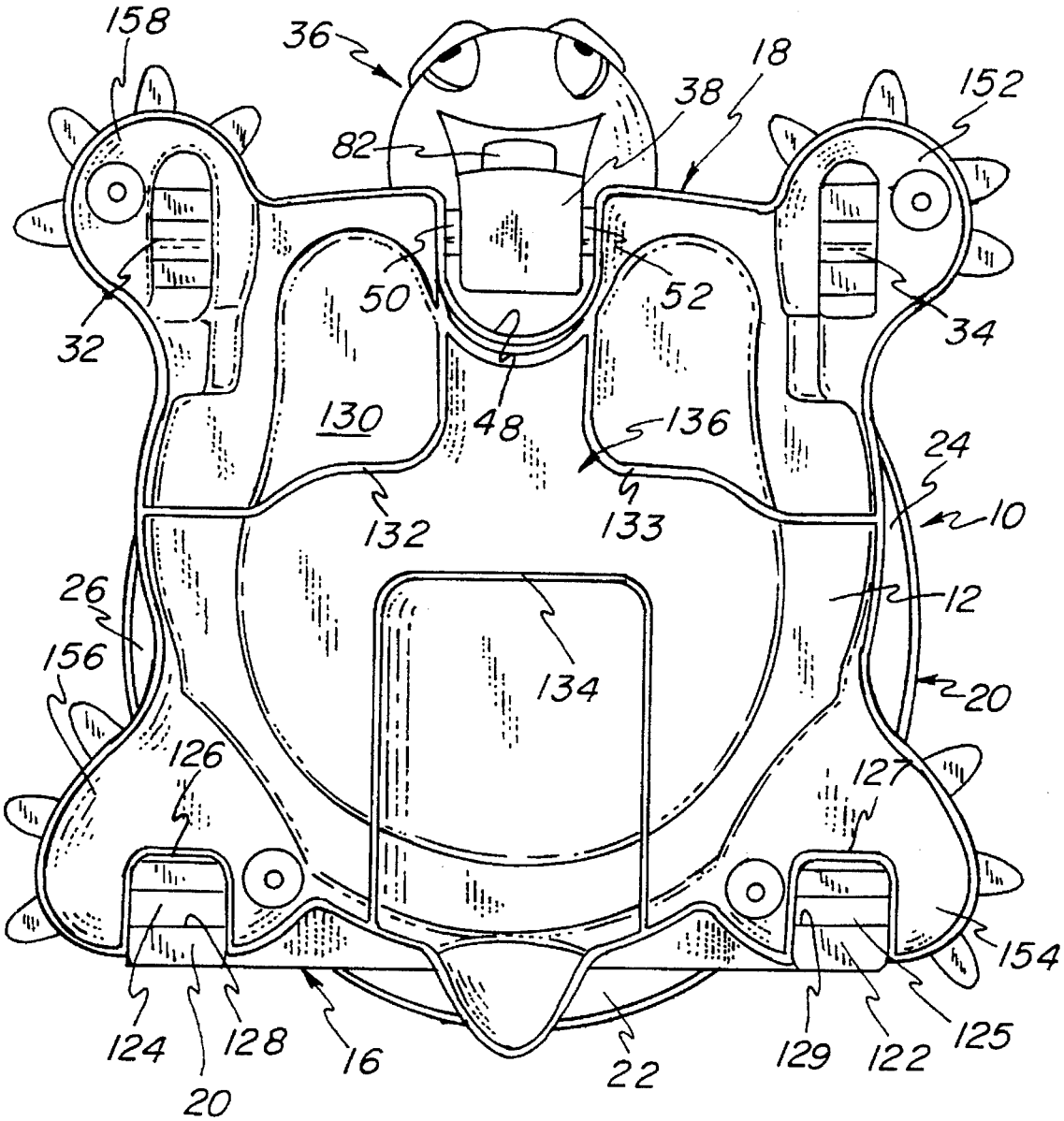
FIG. 6 is a bottom plan view of the base portion of the bath ring.

Referring to FIG. 5, a mechanism generally indicated by the numeral 142 is provided for holding rear support member 116 in interlocking engagement with ring portion 20 is illustrated. This mechanism is shown and described in U.S. Pat. No. 5,317,765 with respect to a rear post 34, and is hereby incorporated by reference. More specifically, curved back section 22 of ring portion 20 is provided with a downwardly facing groove for receiving upper portion 118 of rear support member 116. Upper portion 118 preferably includes a resilient tongue member molded integrally with rear support member 116 for resiliently supporting a tab or pawl member which is adapted to be received through a slot formed in back section 22 of ring portion 20. Thus, the pawl member and slot cooperate in interlocking engagement to prevent relative movement between ring portion 20 and rear support member 116, and the pawl member may be moved forwardly out of engagement with the slot to permit ring portion 20 to move upwardly such that rear support member 116 may be moved into its storage position.

It will further be seen that bath ring 10 includes a plurality of members 152, 154, 156, and 158 which extend outwardly from base portion 12 in order to counteract tipping forces which may be applied to ring portion 20. As best seen in FIGS. 2 and 6, members 152, 154, 156 and 158 are preferably located substantially symmetrically about base portion 12 and optimally adjacent first and second leg sections 28 and 30 of ring portion 20 and first and second lower portions 120 and 122 of rear support member 116. It will be understood that members 152, 154, 156, and 158 may include anti-skid pads associated with a bottom surface thereof in order to further discourage lateral movement of bath ring 10, but are not required to provide the main function of counteracting tipping forces.

It should be noted that each of the components forming bath ring 10 is preferably formed of a plastic material such that bath ring 10 is adapted to be respectively used in water without corroding. Further, as seen in the figures, bath ring 10 may be designed so as to give an overall appearance of an animal or other object for aesthetic and other purposes.

Having shown and described the preferred embodiment of the present invention, further adaptations of the bath ring and the associated locking mechanism for the front retaining member can be accomplished by appropriate modifications by one of ordinary skill in the art without departing from the scope of the invention. In particular, it will be noted that front retaining member 36 and the associated locking mechanism 70 may be utilized with a collapsible bath ring as described herein or with one which has a fixed structure.

We claim:

1. A bath ring, comprising:

(a) a base portion;

(b) a ring portion having a back portion for supporting the back of a person seated on said base portion;

(c) attachment means connecting said ring portion to said base portion;

(d) restraining means extending upwardly from a front edge of said base portion, said restraining means further comprising:

(1) a first portion being pivotable about said base portion;

(2) a second portion having a pair of distal ends; and (3) a lock mechanism associated with said first and second portions which is adapted to engage with and disengage from a pair of slots located in an inwardly facing surface of said ring portion; and said lock mechanism further comprising:

(i) a first element including a pair of oppositely extending arm members and a central member from which each arm member extends, said central member having the ability to be compressed so that said arm members may be brought closer together; and (ii) a second element extending substantially along said first portion;

wherein said first and second elements are located in adjoining relation so that said central member of said first element is compressed as said second element is moved upwardly.

2. The bath ring of claim 1, said second element further comprising a protruding member extending from a surface of said second element opposite a surface adjacent said first element.

3. The bath ring of claim 2, said restraining means further comprising:

(a) a front cover placed in abutting relationship with said second element, said front cover including an opening positioned therein for said protruding member of said second element to extend therethrough;

(b) a rear cover placed in abutting relationship with said first element; and (c) means for attaching said front and rear covers; wherein said front and rear covers substantially surround said first and second lock mechanism elements.

4. The bath ring of claim 3, said ring portion including a pair of grooves formed therein and said rear cover including a pair of substantially U-shaped cut outs which fit over said ring portion grooves.

5. The bath ring of claim 3, further comprising a pair of pivot pins located between a lower portion of said front and rear covers wherein said restraining means is able to pivot about said pivot pins.

6. The bath ring of claim 1, said first element further comprising a pair of tabs located on said central member and said second element further comprising a pair of ribs extending from a surface adjacent said first element, said ribs being spaced apart so that said tabs fit snugly therebetween, wherein said tabs and said ribs are oriented at an angle to a vertical axis extending through said lock mechanism.

7. The bath ring of claim 1, wherein said central member comprises an annular spring.

8. The bath ring of claim 1, said arm members each having a tip lockingly engageable with said slots.

9. The bath ring of claim 8, wherein said arm members are brought together and said tips are disengaged from said ring portion slots substantially simultaneously when said central member is compressed.

10. The bath ring of claim 1, further comprising a plurality of members extending outwardly from said base portion to counteract tipping forces applied against said ring portion.

11. The bath ring of claim 1, further comprising support means extending between said base portion and said ring portion to engage and support said ring portion at a location above said base portion.

12. The bath ring of claim 11, said support means having an upper portion attached to said ring portion and a pair of oppositely extending lower portions being pivotably attached to said base portion.

13. The bath ring of claim 12, said base portion including a slot on a bottom surface thereof conforming to said support means, wherein said support means is able to be detached from said ring portion and pivoted to a stored position underneath said base portion.

14. The bath ring of claim 1, wherein said ring portion is adapted to pivot about said attachment means toward said base portion.

15. The bath ring of claim 1, said restraining means having a substantially T-shaped configuration.

16. A bath ring, comprising:

(a) a base portion including a lower portion for engaging a surface to support said bath ring and an upper surface for supporting a person sitting in an upright position on said bath ring, said base portion defining a front edge and an opposing rear edge for said bath ring;

(b) a ring portion including a curved back section, first and second arm sections extending forwardly from said back section, and first and second leg sections extending downwardly from said first and second arm sections, respectively;

(c) attachment means coupling said first and second leg sections to said base portion adjacent to said front edge;

(d) a T-bar including a vertical section having a first end attached to said base portion at a pivot connection between said first and second leg sections and a second end attached to a horizontal section of said T-bar;

(e) locking means located within said T-bar, said locking means being mounted for sliding movement toward and away from a locking surface in at least one of said first and second arm sections, said locking means cooperating with said locking surface in interlocking engagement to prevent relative movement between said T-bar and said ring portion; and said locking means further comprising:

(i) a first element located along said T-bar vertical section, said first element including a spring member biasing said first element away from said T-bar horizontal section; and (ii) a second element located along said T-bar horizontal section, said second element including a pair of oppositely extending latch members and a spring member positioned between and biasing said latch members away from said T-bar vertical section;

wherein said first and second elements are in mating relation so that said latch members move toward each other as said first element is moved toward said T-bar horizontal section.

17. The bath ring of claim 16, wherein said T-bar horizontal section includes a cut-out area adjacent each distal end which fits over said first and second arm sections of said ring portion.

18. A bath ring comprising:

a base portion;

a ring portion supported on said base portion:

a front retaining member comprising a T-bar including a central vertical section and a horizontal section having end portions wherein said T-bar is supported for movement relative to said ring portion;

a locking mechanism including a first element extending along said horizontal section and including locking tip portions for engaging said ring portion in locking engagement at said end portions of said horizontal section, and a second element located on said T-bar for actuating said first element for movement; and wherein actuation of said first element causes said locking tip portions to simultaneously move toward each other and thereby out of engagement with said ring potion and thereby release said T-bar for movement relative to said ring potion.

19. The bath ring of claim 18 wherein said first element comprises a pair of oppositely extending arm members and a central member from which each arm member extends.

20. The bath ring of claim 19 wherein said central member comprises a spring member.

21. The bath ring of claim 18 wherein said ring portion includes slots for receiving said locking tip portions therein whereby said front retaining member is locked in place on said ring portion.

22. The bath ring of claim 18 wherein said second element is movable along said vertical section to actuate said first element.

23. The bath ring of claim 18 wherein said front retaining member is supported for pivotal movement on said base portion.

* * * * *